US009170532B2

(12) United States Patent
Yang et al.

(10) Patent No.: US 9,170,532 B2
(45) Date of Patent: Oct. 27, 2015

(54) ITERATIVE LEARNING CONTROL FOR MOTION ERROR REDUCTION

(75) Inventors: Ming Yang, Fairport, NY (US); Marina L. Tharayil, Rochester, NY (US); William J. Nowak, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 982 days.

(21) Appl. No.: 12/956,559

(22) Filed: Nov. 30, 2010

(65) Prior Publication Data

US 2012/0059617 A1 Mar. 8, 2012

Related U.S. Application Data

(60) Provisional application No. 61/380,192, filed on Sep. 3, 2010.

(51) Int. Cl.
*G03G 15/00* (2006.01)
*G03G 15/16* (2006.01)

(52) U.S. Cl.
CPC .... *G03G 15/167* (2013.01); *G03G 2215/00405* (2013.01)

(58) Field of Classification Search
CPC ..... G03G 2215/0478; G03G 2215/0485; G03G 2215/0154; G03G 15/167; G03G 2215/00405
USPC ..... 399/16, 117, 116, 121, 394, 42, 66
See application file for complete search history.

(56) References Cited

U.S. PATENT DOCUMENTS

| | | | | |
|---|---|---|---|---|
| 3,555,252 | A | 1/1971 | Garden | |
| 4,806,980 | A | 2/1989 | Jamzadeh et al. | |
| 6,009,298 | A * | 12/1999 | Sakamaki et al. | 399/318 |
| 6,606,215 | B1 | 8/2003 | Eddy et al. | |
| 6,819,521 | B2 | 11/2004 | Ho et al. | |
| 7,058,325 | B2 | 6/2006 | Hamby et al. | |
| 7,286,776 | B2 * | 10/2007 | Morita et al. | 399/36 |
| 2005/0134677 | A1 * | 6/2005 | Kawasaki et al. | 347/238 |
| 2006/0153588 | A1 * | 7/2006 | Sakai et al. | 399/110 |
| 2006/0257158 | A1 | 11/2006 | Calamita | |
| 2009/0116879 | A1 * | 5/2009 | Nedelin | 399/297 |

OTHER PUBLICATIONS

Hays, D.A., et al., "Electrophotographic copying and printing (xerography)", The Optics Encyclopedia: Basic Foundation and Practical Applications, Eds. Wiley, 2004.

(Continued)

*Primary Examiner* — Matthew G Marini
(74) *Attorney, Agent, or Firm* — Hoffmann & Baron, LLP

(57) ABSTRACT

An apparatus for reducing registration errors in a media handling device. The apparatus including an image-bearing member having sheets individually pass across the image-bearing member. Each sheet pass corresponds to one of a series of iterations between the image-bearing member and the sheets. The image-bearing member is operatively coupled to a controller for regulation motion of the image-bearing member. The controller receives input signals representing at least one measured disturbance. Each disturbance being defined by a pattern of image-bearing member movement away from and substantially returning to a reference state of motion. A repetition of the pattern being coincident with at least one of the iterations, wherein based on the measured disturbance, the reference state and an indication associated with when the pattern will repeat, a modified signal is generated for the actuator to adjust the image-bearing member motion in coordination with the indication.

21 Claims, 6 Drawing Sheets

(56) References Cited

OTHER PUBLICATIONS

Ming Yang, "A Process Direction Dynamic Model for High Precision Web/Belt Transport Systems", The Tenth International Conference on Web Handling, Jun. 7-11, 2009, Stillwater, Oklahoma.

Bristow, D.A, et al., "A Survey of Iterative Learning Control", IEEE Control Systems Magazine, vol. 26, No. 3, pp. 96-114, 2006.

Tharayil, M. et al., "A Time-Varying Iterative Learning Control Scheme", Proceedings of the American Control Conference, Boston, 2004.

* cited by examiner

ITERATIVE LEARNING CONTROL FOR MOTION ERROR REDUCTION

CROSS REFERENCE TO RELATED APPLICATIONS

This application claims priority to provisional patent application Ser. No. 61/380,192 filed on Sep. 3, 2010, which is incorporated herein by reference.

TECHNICAL FIELD

The presently disclosed technologies are directed to systems and methods used to reduce registration errors in a media handling device, such as marking devices, including printing system. The systems and methods described herein use iterative learning control in order to anticipate and compensate for repeating exogenous disturbances to the media handling device.

BACKGROUND

In media handling assemblies, particularly in printing systems, accurate and reliable registration of an image as it is transferred is desirable. In particular, accurate registration of an image as it is transferred to a target substrate media or intermediate transfer belt has a direct correlation to image quality.

Contemporary media handling assemblies use controllers, in the forms of automated processing devices, in order to maintain control of the sheets they are handling. Often that control is maintained by adjusting a drive roller or belt velocity which conveys images and/or sheets of paper on transfer belts to a delivery registration datum. A velocity/position command profile is computed by the controller using an algorithm that is designed to deliver the image and/or sheet at a target time to the right place within the system. An actuator commanded by the controller then executes that command profile in order to timely and accurately deliver the image and/or sheet. Such systems are particularly common in printing systems, but are also found in other substrate media handling assemblies.

Typically, control algorithms are employed to analyze the way the system is operating by measuring or monitoring its movement. The control algorithm attempts to control most motion errors, particularly ones that develop slowly and are inherent characteristics of the system itself. One example of such control techniques is feedback control. Feedback control uses a closed-loop system that reacts to inputs and disturbances occurring during system operation. However, as feedback control is reactionary, it tends to lag in its response and thus may not compensate fully for quick or brief disturbances.

Another control technique is the traditional feedforward control, which uses an open-loop system that accumulates information for future use based on the preliminary calibration and/or setup of the system. The feedforward control can eliminate the response lag and anticipate known system disturbances, even quick or brief ones, but it does not respond to exogenous errors, even repeating disturbances that are not part of the initial system calibration.

Those traditional control algorithms do not control errors that occur due to rapidly changing disturbances caused by external influences, such as when a sheet of paper in the normal paper path of the system makes impact with an internal transfer belt, nip assembly or other surface. When the leading edge of a sheet hits a media transfer belt, the nip rollers or similar elements in a system, there is a resultant disturbance that briefly occurs, even though these impacts are anticipated. Similarly, when the trailing edge of that same sheet no longer makes contact with those elements, there can also be a resultant disturbance that briefly occurs. These disturbances are cyclical because as each of a plurality of identical sheets get conveyed through that part of the system, those sheets are not considered part of that system. Particularly since the substrate media can come in different weights, sizes and even material composition. When a novel sheet is introduced to the system, such as, for example, during initialization of a printing machine, when feed trays are changed, and/or when switching between two sheet types, performance of the overall system may change. What is more, the unique characteristics of that novel sheet can change once again with the next print job, that uses an even different substrate media.

The unique disturbances caused by a particular set of sheets on the system are considered exogenous since those sheets are not considered part of the media handling assembly. Such exogenous disturbances are not fully compensated for by feedback control or contemporary feedforward control systems. Also, such exogenous disturbances are not consistent between different substrate media, making them somewhat unique for each set.

Accordingly, it would be desirable to provide a system and method capable of more accurately reducing registration errors in a media handling assembly, and thereby overcomes the shortcoming of the prior art.

SUMMARY

According to aspects described herein, there is disclosed an apparatus for reducing registration errors in a media handling device. The apparatus includes a transport handler, namely a image-bearing member, at least one sensor, an actuator and an interative learning controller. The image-bearing member interacts with sheets of substrate media as the sheets individually pass across the image-bearing member. Each sheet pass corresponds to one of a series of iterations between the image-bearing member and the sheets, wherein the image-bearing member conveys marking material corresponding to an image. The actuator communicating motion to the image-bearing member. The controller operatively coupled to the actuator, wherein the controller receives input signals, at least a portion of the input signals representing at least one measured disturbance. Each disturbance being defined by a pattern of image-bearing member movement away from and substantially returning to a reference state of motion. A repetition of the pattern being coincident with at least one of the iterations, wherein based on the measured disturbance, the reference state and an indication associated with when the pattern will repeat, a modified signal is generated for the actuator to adjust the image-bearing member motion in coordination with the indication.

According to other aspects described herein, the image-bearing member can directly engage one of the sheets during each iteration. Also, the input signals can be received from a sensor arranged to measure at least one disturbance to the image-bearing member. The disturbance can include image-bearing member movement caused by at least one of sheet impact with and disengagement from the image-bearing member. The reference state can be derived from at least one of pre-set values, calibration measurements and movement patterns determined from at least one earlier iteration. The adjusted image-bearing member motion can be effected immediately preceding, during and/or immediately after when the pattern is indicated to repeat. The image-bearing member can be a nip roller, a transfer belt or an imaging drum. Additionally, the apparatus can include a sheet position sensor for indicating when the pattern will repeat, the sheet position sensor operatively coupled to the controller. Further, the image-bearing member motion can be adjusted by varying a target velocity profile for the actuator as a function of at least one prior iteration. The at least one measured disturbance can include two disturbances during the same one of the iterations. Further still, one of the at least two disturbances can correspond to image-bearing member movement caused by a sheet impact therewith and another of the at least two disturbances corresponds to a sheet disengagement from the image-bearing member.

According to another aspects described herein, there is disclosed an apparatus for reducing registration errors in a media handling device. The apparatus includes an intermediate transfer belt, a sheet transfer belt and a controller. The intermediate transfer belt for conveying marking material corresponding to an image. The intermediate transfer belt interacts with sheets of substrate media as the sheets are individually conveyed across the intermediate transfer belt, wherein the passing interaction of each of the sheets with the intermediate transfer belt corresponds to one of a series of iterations between the intermediate transfer belt and the sheets. The sheet transfer belt conveys the sheets into engagement with the intermediate transfer belt. The controller is operatively coupled to at least one of the intermediate transfer belt and the sheet transfer belt. The controller receives input signals, wherein at least a portion of the input signals represent at least one measured disturbance. Each disturbance being defined by a pattern of intermediate transfer belt movement away from and substantially returning to a reference state of motion, a repetition of the pattern being coincident with at least one of the iterations. Based on the measured disturbance, the reference state and an indication associated with when the pattern will repeat, a modified signal is generated for adjusting the intermediate transfer belt motion in coordination with the indication.

According to other aspects described herein, the input signals can be received from a sensor arranged to measure at least one disturbance to the intermediate transfer belt. The disturbance can include intermediate transfer belt movement caused by at least one of sheet impact with and disengagement from the intermediate transfer belt. The reference state can be derived from at least one of pre-set values, calibration measurements and movement patterns determined from at least one earlier iteration. The adjusted intermediate transfer belt motion can be effected at least one of immediately preceding, during and immediately after when the pattern is indicated to repeat. Additionally, the apparatus can include a sheet position sensor for indicating when the pattern will repeat, where the sheet position sensor can be operatively coupled to the controller. The intermediate transfer belt motion can be adjusted by varying a target velocity profile thereof as a function of at least one prior iteration. The at least one measured disturbance can include two disturbances during the same one of the iterations. Also, one of the at least two disturbances can correspond to intermediate transfer belt movement caused by a sheet impact therewith and another of the at least two disturbances can correspond to a sheet disengagement from the intermediate transfer belt.

According to another aspects described herein, there is disclosed an apparatus for reducing registration errors in a media handling device. The apparatus includes a first image-bearing member and a second image-bearing member, at least one sheet transfer member and a controller. The first and second image-bearing members conveying marking material corresponding to at least a portion of an image. Each of the image-bearing members interacts with sheets of substrate media as the sheets individually pass across the respective image-bearing members, wherein one sheet pass across one of the image-bearing members corresponds to one of a series of iterations between the image-bearing members and the sheets. The at least one sheet transfer member conveying the sheets into direct engagement with the first image-bearing member and subsequently the second image-bearing member. The controller operatively coupled to the first and second image-bearing members and the at least one sheet transfer member. The controller receives input signals, at least a portion of the input signals representing at least one measured disturbance. Each disturbance being defined by a pattern of movement of at least one of the first and second image-bearing members away from and substantially returning to a reference state of motion. A repetition of the pattern being coincident with at least one of the iterations, wherein based on the measured disturbance, the reference state and an indication associated with when the pattern will repeat, a modified signal is generated for adjustment of the at least one of the image-bearing members motion in coordination with the indication.

According to other aspects described herein, the first and second image-bearing members can both separately engage each of the sheets in consecutive iterations. The disturbance can include first image-bearing member movement and the modified signal can adjusts the motion of the second image-bearing member. The disturbance can include first image-bearing member movement and the modified signal can adjust the motion of the first image-bearing member as part of a subsequent iteration. The reference state can be derived from at least one of pre-set values, calibration measurements and movement patterns determined from at least one earlier iteration. The adjusted image-bearing member motion can be effected at least one of immediately preceding, during and immediately after when the pattern is indicated to repeat. The at least one image-bearing member motion can be adjusted by varying a target velocity profile as a function of at least one prior iteration. The at least one measured disturbance can include two disturbances during the same one of the iterations. One of the at least two disturbances can correspond to movement of one of the image-bearing members caused by a sheet impact therewith and another of the at least two disturbances can correspond to a sheet disengagement from the same image-bearing member. The first and second image-bearing members can each be disposed in separate modular units, the modular units can be substantially similar to one another.

According to other aspects described herein, there is disclosed a method of reducing registration errors in a media handling system. The method includes receiving input signals from a sensor arranged to measure disturbances to an image-bearing member. The image-bearing member interacts with sheets of substrate media as the sheets individually pass across the image-bearing member, each sheet pass corresponding to one of a series of iterations between the image-bearing member and the sheets. At least a portion of the input signals represent at least one measured disturbance. Each disturbance being defined by a pattern of image-bearing member movement away from and substantially returning to a reference state of motion. A repetition of the pattern corresponding to one of the iterations. The method also including comparing the measured disturbance and the reference state. Also, the method including generating a modified signal for adjusting the image-bearing member motion in coordination with an indication associated with when the pattern will repeat, the measured disturbance and the reference state.

According to other aspects of the method described herein the comparison of the measured disturbance and the reference state can repeat over a plurality of consecutive iterations. The modified signal can at least temporarily change a velocity profile for an actuator regulating the image-bearing movement, where the velocity profile can change as a function of a previous velocity profile from a preceding iteration. The modified signal can adjust image-bearing member motion to coincide with at least one of an impact or disengagement between the image-bearing member and one of the sheets. The reference state can represent movement patterns determined from prior iterations. The reference state can include motion characteristics predetermined as at least one of a normal and default mode of operation for the image-bearing member. The method can also include receiving the indication of when the pattern will repeat, the indication received from another sensor configured to detect at least one of sheet position and movement characteristics.

According to other aspects described herein, there is disclosed a method of reducing registration errors in a modular media handling system. The method including receiving input signals from a first sensor arranged to measure disturbances to a first image-bearing member, wherein the first image-bearing member interacts with sheets of substrate media as the sheets individually pass across the first image-bearing member. Each sheet pass corresponds to one of a series of iterations between the first image-bearing member and the sheets. At least a portion of the input signals represent at least one measured disturbance. Each disturbance being defined by a pattern of first image-bearing member movement away from and substantially returning to a reference state of motion, a repetition of the pattern corresponding to one of the iterations. The method also includes comparing the measured disturbance and the reference state. Also, the method includes generating a modified signal for adjusting the motion of a second image-bearing member in coordination with an indication of when the pattern will occur with respect to the second image-bearing member, the modified signal determined by the comparison of the measured disturbance and the reference state.

Additionally, the indication of when the pattern will occur with respect to the second image-bearing member can be transmitted from a second sensor configured to detect at least one of sheet position and movement characteristics relative to the second image-bearing member. Also, the reference state can include predetermined motion characteristics of at least one of the first and second image-bearing members.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
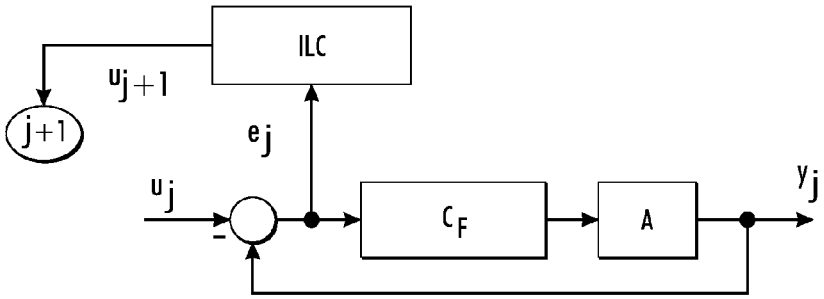
FIG. 1 shows a schematic representation of control signals received and output by an ILC controller and a feedback controller used in series for a media handling assembly in accordance with an aspect of the disclosed technologies.

Describing now in further detail exemplary embodiments with reference to the Figures, as briefly described above. The disclosed technologies reduce registration errors using iterative learning control for repeatable disturbances. The systems and methods disclosed herein can be used in a select location or multiple locations of a paper path or paths of various conventional media handling assemblies. Thus, only a portion of an exemplary media handling assembly path is illustrated herein.

As used herein, a "media handling assembly" refers to one or more devices used for handling and/or transporting substrate media, including feeding, marking, printing, finishing, registration and transport systems.

As used herein, a "marking device," "printer," "printing assembly" or "printing system" refers to one or more devices used to generate "printouts" or a print outputting function, which refers to the reproduction of information on "substrate media" for any purpose. A "marking device," "printer," "printing assembly" or "printing system" as used herein encompasses any apparatus, such as a digital copier, bookmaking machine, facsimile machine, multi-function machine, and the like, which performs a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, "substrate media" refers to, for example, paper, transparencies, parchment, film, fabric, plastic, photofinishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein, the term "actuator" refers to a device or assembly of elements that communicate or impart motion to another element, such as a transport handler, or directly regulates the motion of that element. In particular, an actuator is a mechanical device that accepts a data signal and performs an action based on that signal. Actuators include those mechanical devices that can impart motion to a drive wheel, a transfer belt, an imaging drum and other elements of the media handling device.

As used herein, a "nip assembly" or "nip assemblies" refers to an assembly of elements that include at least two adjacent revolving or recirculating elements and supporting structure, where the two adjacent revolving or recirculating elements are adapted to matingly engage opposed sides of a transfer belt or substrate media. A typical nip assembly includes two wheels (rollers) that cooperate to drive or handle a substrate therebetween. One or two of the opposing wheels can include a driven wheel, one or two of the opposing wheels can be a freely rotating idler wheel or the opposed wheels can be a combination thereof. Together the two wheels guide or convey the transfer belt or other substrate within a media handling assembly. More than two sets of mating wheels can be provided in a laterally spaced configuration to form a nip assembly. It should be further understood that such wheels are also referred to interchangeably herein as rolls or rollers. Once a substrate is engaged between the opposed revolving or recirculating elements, the space or gap between them is referred to as the "nip" or "nip gap".

As used herein, the term "belt" or "transfer belt" refers to, for example, an elongated flexible web supported for movement along a process flow direction. For example, an image transfer belt is capable of conveying an image in the form of toner for transfer to a substrate media. Another example includes a media transfer belt, which preferably engages and/or conveys a substrate media within a printing system. Such belts can be endless belts, looping around on themselves within the printing system in order to continuously operate. Accordingly, belts move in a process direction around a loop in which they circulate. A belt can engage a substrate media and/or carry an image thereon over at least a portion of the loop. Image transfer belts for carrying an image or portions thereof can include non-stretchable electrostatic or photoreceptor belts capable of accumulating toner thereon.

As used herein, the term "image-bearing member" refers to one or more elements that directly engages the substrate media as it moves through at least a portion of the greater media handling assembly. Image-bearing members can carry or manipulate an image directly, such as a latent image on an imaging drum or intermediate transfer belt, or manipulate a substrate media bearing an image or intended to receive an image thereon, such as a nip assembly. Image-bearing members can thus include nip wheels, transfer belts, imaging drums and other elements of the media handling device that convey or carry an image that has been applied to or is going to be applied to a substrate media.

As used herein, "sensor" refers to a device that responds to a physical stimulus and transmits a resulting impulse signal for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media or a transfer belt, such as speed, orientation, position and disturbances from expected values. Thus, reference herein to a "sensor" can include more than one sensor.

As used herein, the terms "process" and "process direction" refer to a process of moving, transporting and/or handling an image or substrate media conveyed by a transfer belt. The process direction substantially coincides with a direction of a flow path P along which the image or substrate media is primarily moved within the media handling assembly. Such a flow path P is said to flow from upstream to downstream.

Iterative learning control (ILC) generates a feedforward control that tracks a specific reference and identifies a repeating disturbance from that reference. ILC has advantages over traditional feedback control and feedforward control techniques. In particular, ILC is anticipatory and can compensate for exogenous signals, such as repeating disturbances, in advance by learning from previous iterations. Accordingly, ILC does not require that the exogenous signals (comparing the specific references to the disturbances) be known or measured ahead of time. The ILC uses the repetition of the disturbances from iteration to iteration to improve future performance.

Traditionally, ILC has been applied to the performance of systems that execute a single, repeated operation without variation or disturbances. The technique has been applied to product manufacturing, robotics and chemical processing, where mass production on an assembly line entails extensive repetition. Also, ILC has found application to systems that do not have identical repetition, like underwater robots that use similar motions but at different speeds. However, these motions can be equalized by a time-scale transformation in order to correlate the conditions and/or parameters.

ILC is based on the notion that performance of a system that executes the same task multiple times can be improved by learning from previous executions (trials, iterations, passes). For example, a ball player throwing a ball from a fixed position can improve his or her accuracy by practicing the shot repeatedly. During each shot, the ballplayer observes the trajectory of the ball and consequently plans any alterations in the throwing motion for the next attempt. As the player continues to practice, an improved motion is learned and becomes engrained in the muscle memory so that the shooting accuracy is iteratively improved. The converging muscle motion profile is an open-loop control generated through repetition and learning. This type of learned open-loop control strategy is the essence of ILC. The basic principles of ILC are disclosed in U.S. Pat. No. 3,555,252 as well as the paper titled "A Survey of Iterative Learning Control," by Bristow, D. A., M. Tharayil, and A. G. Alleyne, *IEEE Control Systems Magazine*, vol. 26, no. 3, pp. 96-114, 2006, both of which are incorporated herein by reference.

ILC differs from other learning-type control strategies, such as adaptive control, neural networks and repetitive control. Adaptive control strategies modify the controller, which is part of the system whereas ILC modifies the control input, which is a signal. Additionally, adaptive controllers do not take advantage or analyze the information contained in repetitive command signals. Similarly, neural network learning involves the modification of controller parameters, rather than a control input signal. In this way, such neural networks require extensive training data to define a model of network behavior and will not adapt quickly to new repeating disturbances arising within a few iterations.

Repetitive control is further distinguished in that it is intended for continuous operation, whereas ILC is intended for discontinuous operation. For example, an ILC application could control a task that returns to a home position, thus coming to rest before repeating the task. In contrast, repetitive control applications tend to control activities wherein after each iteration the next iteration follows without the system returning to a home position. In this way, those initial condition parameters are not consistent for each iteration. In repetitive control, the initial conditions are merely set to the final conditions of the previous iteration. In this way, repetitive control is intended for continuous operation whereas ILC is intended for discontinuous operation.

ILC as used herein refers to an approach to improve the transient response performance of an unknown or uncertain hardware system that operates repetitively over a fixed time interval by eliminating the effects of a repeating disturbance and by using the previous actual operation data and/or system setup calibration data. In accordance with an aspect of the disclosed technology herein, ILC is used as either a primary control when the system mainly undergoes repeatable disturbances or as a secondary control when both slowly changing and rapidly varied disturbances dominate. In particular, in a media handling device, such as a printer, when a substrate media first makes contact with a nip assembly or is transferred onto a belt in the system, there is a minor but notable impact that results in a system disturbance. That disturbance results in motion errors for the nip assembly or belt. Adding ILC at localized intervals of time to counter the effect of these types of disturbances can be an effective technique to improve motion quality within the system.

Figure 2:
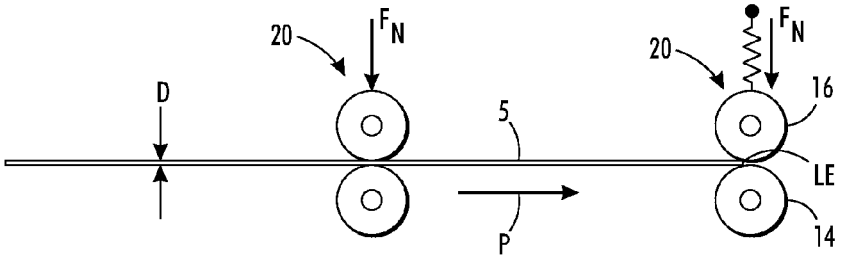
FIG. 2 shows a schematic side elevation view of a sheet of substrate media interacting with image-bearing members in the form of two nip assemblies in accordance with an aspect of the disclosed technologies.

FIG. 2 shows a basic representation of two nip assemblies 20 for engaging a sheet 5 being conveyed in a process direction P. Such nip assemblies 20, which generally include a drive roller 14 and an idler roller 16 are commonly found in a media handling assembly. The nip assemblies 20 interact with sheets, generally one-by-one in series, where the passing engagement of each sheet with the nip corresponding to an iteration of sheet handling. Thus, with each iteration a sheet is engaged by, passes across and is released from a nip assembly 20. Often, such nip assemblies 20 are used to steer or change a velocity profile of the sheet 5 during an iteration of it passing through the system. Thus, as part of the sheet engagement required to manipulate the sheet 5, there will be an initial impact as the sheet squeezes between the nip rollers 14, 16 into the nip there between. Regardless of whether there is a nip gap before the sheet arrives (a space can be maintained between opposed nip rollers 14, 16, that is smaller than the sheet width D), an impact force against at least one of the nip rollers 14, 16 will occur. The sheet 5 is shown already engaged by the upstream nip assembly (on the left in the drawing) and its leading edge LE has reached the moment of impact with the downstream nip assembly (on the right in the drawing). The moment of impact (when the sheet 5 leading edge first touches either roller of the nip assembly 20), as well as the moment of release (when the sheet 5 trailing edge no longer engages the nip assembly) can cause a transient measureable disturbance.

Figure 3:
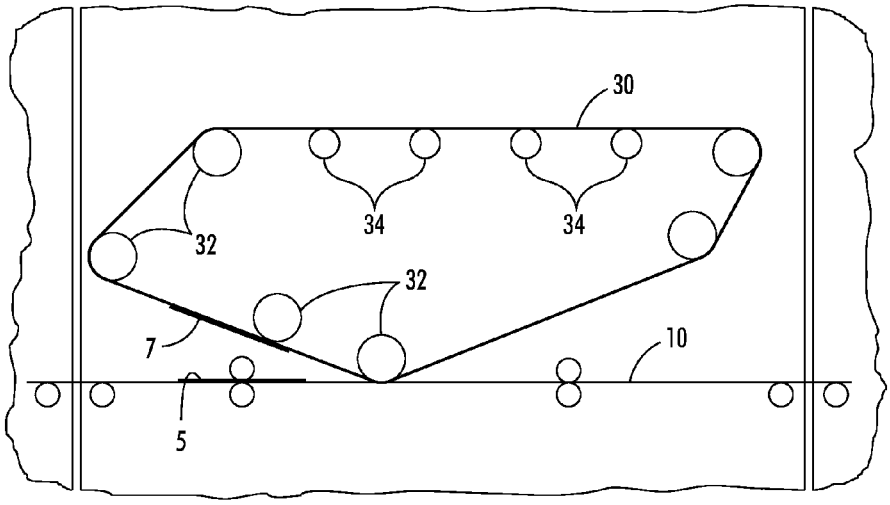
FIG. 3 shows a schematic side elevation view of a media handling assembly conveying a sheet toward an image-bearing members in the form of an intermediate transfer belt and an exemplary sheet registration nip assembly in accordance with an aspect of the disclosed technologies.

FIG. 3 shows an example of another media handling device where a sheet 5 is conveyed on a media transfer belt 10 and the sheet 5 is made to impact an image-bearing member, which in this example is an intermediate transfer belt 30. The intermediate transfer belt 30 being a recirculating continuous belt supported by various rollers 32, 34 and conveying an image 7. The image 7 can be a complete image or portion thereof to be subsequently combined with other portions. Typically an electrostatic or photoreceptor belt capable of accumulating toner or other latent image thereon is used as an intermediate transfer belt 30. As with the nip assembly example above, an iteration of sheet handling for the intermediate transfer belt 30, as with any image-bearing member, involves a single sheet 5 passing across the belt 30 at the transfer nip. The transfer nip refers to the place where the intermediate transfer belt 30 and the media transfer belt 10 meet or nearly meet to engage the passing sheet 5. The iteration includes the moment when the sheet 5 makes impact with the belt 30 as it is received at the transfer nip, as well as when the sheet 5 is released from the belt once it exits the transfer nip. That moment of impact and release can each cause a transient measurable disturbance.

Figure 4:
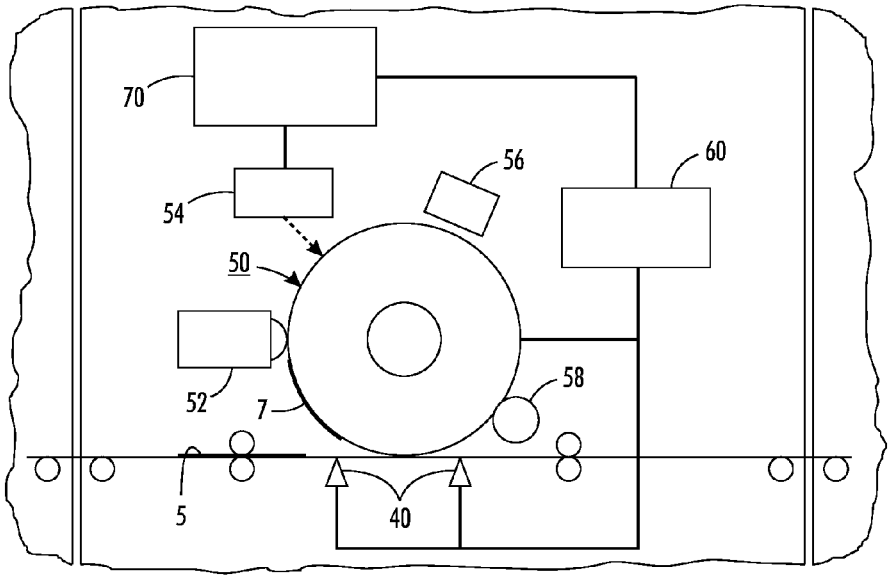
FIG. 4 shows a schematic side elevation view of a media handling assembly conveying a sheet toward an image-bearing members in the form of a photoreceptor drum assembly in accordance with an aspect of the disclosed technologies.

FIG. 4 shows a further example of another media handling device where a sheet 5 will impact an image-bearing member at an image transfer nip. In this example, the image-bearing member is a photoreceptor drum 50. Photoreceptor drums 50 are typically configured with familiar elements of xerographic printing such as a development unit 52, an exposure device 54, a charging device 56, a cleaning device 58 and others (not shown). These devices work together to repeatedly form an image 7, which can also either be a complete image or a portion thereof. Once again, when the sheet 5 makes impact with the drum 50, or similar system surface at the transfer station, there can be a measurable disturbance.

Aspects of the disclosed technologies can be applied to all the media handling devices described above with regard to FIGS. 2-4, as well as any media handling system that is subject to measurable repeating transient disturbances, particularly caused by exogenous sources. FIG. 4 shows a contemporary media handling assembly that includes a controller 70, which comprises an automated processing device receiving instructions and input, in the form of input signals, from operators and automated devices, like sensors 40. The controller also transmits control signals to system devices such as actuators and other subsystems for manipulating the target substrate media 5 and the image 7 to be transferred thereon as desired. Such manipulation can include analyzing, changing the content and/or appearance of the media or just changing the configuration or movement of that media. In accordance with an aspect of the disclosed technology an ILC controller 60 is further incorporated into the system. It should be understood that while the ILC controller 60 is only shown in the system illustrated in FIG. 5, it could be applied to any media handling system. Also, while ILC controller 60 is shown separate from controller 70, the two elements could be incorporated into a single controller or alternatively divided further into a plurality of elements operatively coupled to provide the desired functionality.

In accordance with an aspect of the disclosed technologies the ILC controller 60, along with any other applicable controller 70 will receive input signals from the system sensors 40. As ILC is being applied to measurable disturbances to an image-bearing member, the sensors 40 should be configured to measure such disturbances for comparison to a reference state of motion for that image-bearing member. The reference state of motion represents the normal movement profile for that or similar image-bearing member(s) without the exogenous disturbances targeted by the ILC. In a nip assembly, the sensors can take the form of an encoder on at least one of the rollers to measure and convert the rotational motion of that roller into an electronic signals that gets transmitted to one or more controllers 60, 70. A nip encoder can be mounted on the rotational shaft of one of the rollers, typically the idler roll, and provides a measurement of the angular turn rate of that roller. The idler roll angular turn rate is commonly associated with a localized measurement of either sheet or belt speeds, depending upon what the measured roller is engaging. When an intermediate transfer belt is being measured for disturbances, the belt itself can be measured with sensors or one of the belt rollers 32, 34 can be measured with an encoder, similar to that used with nip assemblies. Similarly, rotational movement of a photoreceptor drum 50 can be directly measured or indirectly measured from the movement of the associated substrate media 5 at it passes. In the end, one or more sensors should transmit input signals to the ILC controller 60 providing the measurement information regarding movement of a particular registration control element. The measurement information is received by the ILC controller 60 in the form of an input signal. The input signal thus may represent the reference state of motion combined with movement caused by a disturbance. While FIG. 4 only illustrates sensors 40 arranged below the lower transfer belt, different or additional sensors as described above can be used to transmit information to the controllers. For example, a further sensor can be used to measure and/or detect movement of the drum 50 caused by disturbances. It should be understood that multiple sensors can be placed in a variety of locations, and still remain within the scope of the present disclosure, which is not limited to use with the systems shown in drawings, which are presented for illustrative purposes.

By directly or indirectly measuring the movement of an image-bearing member, particularly a nip assembly, transfer belt or transfer drum, through the use of one or more sensors, an interactive learning control (ILC) technique can adjust the image-bearing member movement in subsequent iterations, in order to achieve more desirable movement. A more desirable movement includes one that corresponds to better registration within the system, in order to avoid or reduce registration errors and improve image quality on the substrate media.

Media handling devices generally move and manipulate numerous sheets, such as a stack of paper. The passing of each sheet through that device or at least a portion of that device is considered an iteration or cycle that can be used for measurement with ILC. Accordingly, ILC can use a base-line movement (also referred to herein as a "reference state of motion"), such as a reference velocity, of the image-bearing member along with measured disturbances from that base-line movement. That reference state of motion, is represented by a control signal used by the applicable system controller. The control signal generated by the controller dictates the movement of the image-bearing member. Using ILC, the control signal for a current iteration can be modified based on measured error and control signals from past iterations. Presumably, a majority of the signals are repeatable, including the signals representing the error, such as the LE/TE disturbances to the image-bearing member.

ILC corrections can be implemented for a brief period of time T, before and after the LE/TE disturbances, in an attempt to correct for errors and improve image quality. Typically, the sheet LE/TE position and/or arrival time at any point in the system can be predicted accurately by one or more sensors at or near the transfer interface where the image-bearing member engages each passing sheet. Thus, using ILC for a fixed window of time t (where $t \in [0, T]$) the reference velocity $u_{rea}$ (a reference state of motion) is modified to be a time varying reference $u_{ref}(t)$, using an iteration count j to track instances as follows:

$$u_{ref,j+1} = u_{ref,j} + K * e_j \quad (1),$$

where $u_{ref,j}$ is the control input to the system during the $j^{th}$ iteration (j counts the number of instances of LE or TE disturbances), $e_j$ is an exogenous signal for the $j^{th}$ iteration that represents the measured disturbance (i.e., movement, which can be measured by velocity) and K represents a system control parameter in the form of a proportional constant determined by simulation, in accordance with the iterative learning control technique. Thus, $u_{ref,j+1}$ represents a corrected or modified signal for the image-bearing member. The ILC controller thereby calculates a corrective velocity profile for the j+1 iteration, generating $u_{ref,j+1}$, based on input from $u_{ref,j}$, and $e_j$, as well as system control parameters (like pre-set values, default setting and calibration measurements) and possibly information from previous iterations.

These principles of ILC can be incorporated with existing system controllers. Particularly since ILC uses an open-loop control action and will not generally compensate for non-repeating disturbances. Thus, by using it in combination with a contemporary feedback controller $C_F$ further improvements can be achieved that were not available with the feedback controller $C_F$ alone. Also, since many contemporary systems often already include a feedback controller $C_F$, the addition of an ILC controller can generally be implemented without modifying the feedback controller $C_F$. FIG. 1 shows schematically how an ILC controller can be combined with the feedback controller $C_F$ in at least two ways.

The ILC can be arranged in a "serial" application, in conjunction with contemporary feedback control. In this way, the modified input signal transmitted from the ILC controller is applied to the reference signal $u_j$ before the feedback loop. Alternatively, the ILC can be arranged in parallel the feedback control input and combined before a modified signal is sent to be actuator. For the results illustrated in FIG. 5, a serial implementation was used. However, it should be understood that a parallel configuration could be employed to achieve effective results. One or more sensors are used to measure the system velocity performance and predict sheet arrival/exit times. Based on sheet arrival prediction, the ILC controller modifies the velocity reference signal for a pre-determined amount of time. This is done in anticipation of the measured patterned disturbance introduced by sheet entering and/or exiting the transfer nip assembly.

The ILC can be used as a secondary controller in addition to the existing velocity tracking controller. Additionally, other controllers can be provided for high level and low level control of the entire system and/or subsystems.

Figure 5:
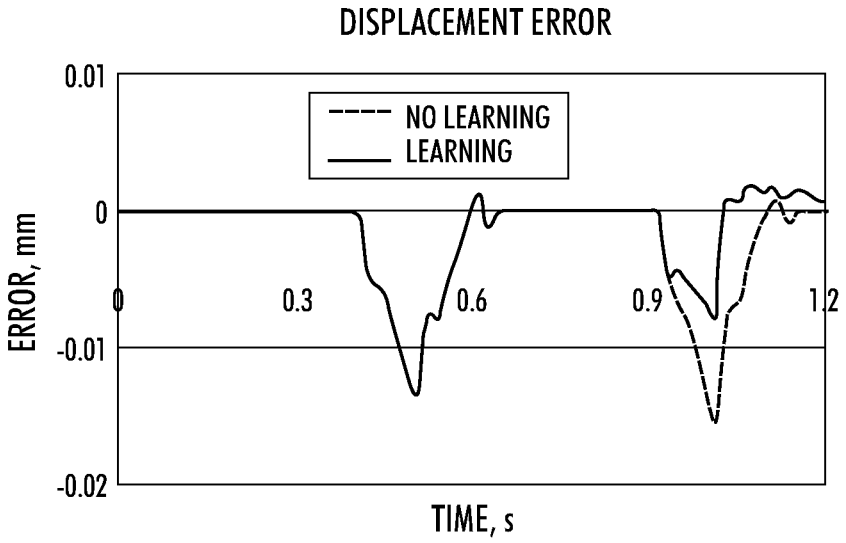
FIG. 5 shows a chart of displacement error across two iterations with and without using ILC techniques, respectively, in accordance with an aspect of the disclosed technologies.

FIG. 5 shows a comparison of the motion error between a system that uses ILC (noted with a solid line) and a system that does not use ILC (noted with a dashed line where the two systems deviate). The chart in FIG. 5 only illustrates results from one iteration of learning, which corresponds to two sheet cycles. For the example, measurements were taken of the movement of an intermediate transfer belt, similar to the configuration shown in FIG. 3. Thus, two sheet 5 leading edges LE made impact with belt 30 and the ILC was applied to the actuator controlling the movement of the second sheet and it's corresponding impact. These results demonstrate how with a single pass of interactive learning, the displacement error for the belt can be reduced by 50%. That error reduction would likely increase further with additional interactions. Such further increased error reductions are made more significant by the fact that without ILC those errors would likely increase with additional iterations.

Figure 6:
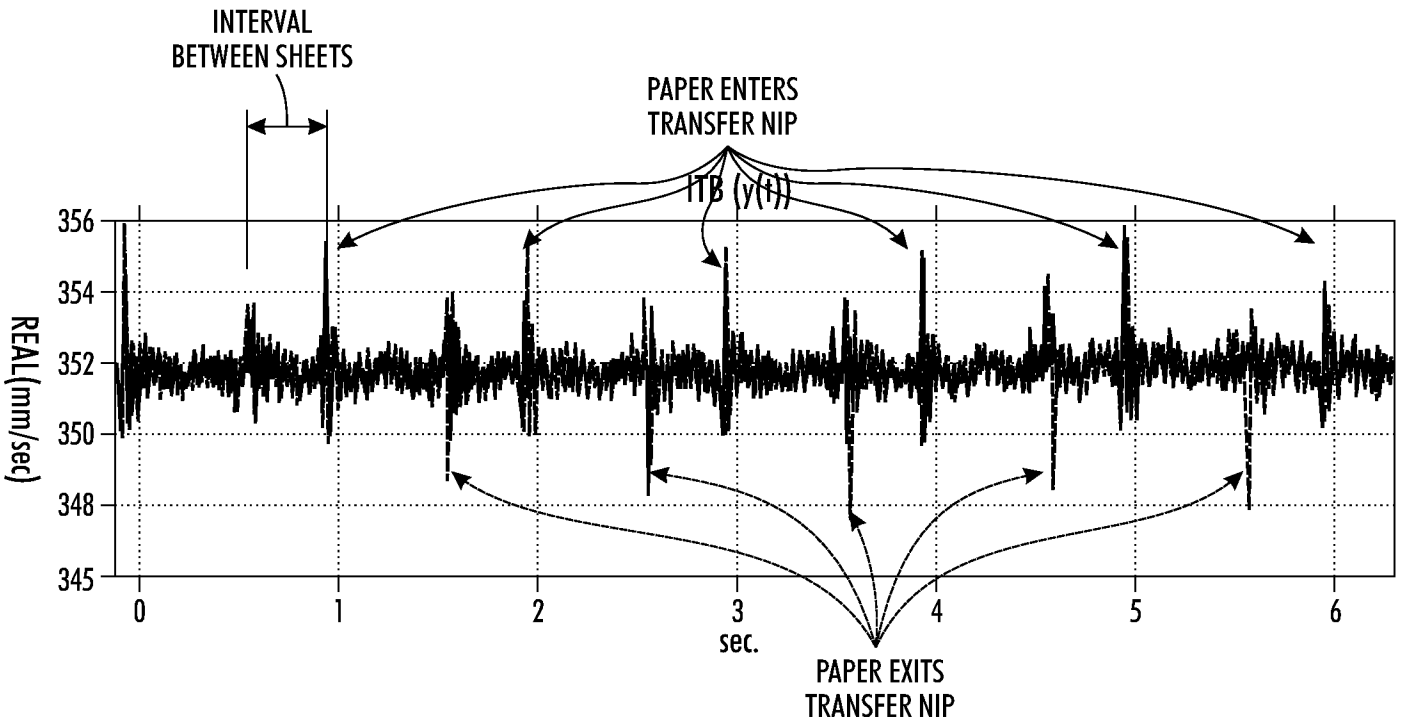
FIG. 6 shows a chart of motion error measurements on an image-bearing member from the paper entering and exiting a transfer nip, over a series of iterations without ILC techniques applied.

FIG. 6 shows an example of in-plane motion measured from an intermediate transfer belt encoder, showing the effect of a paper sheet entering (making impact with) and exiting (disengaging from) a transfer nip. This graph illustrates the velocity of the intermediate transfer belt has a generally sinusoidal pattern that represents a reference state of motion. That reference state is distinguished from the series of spikes extending above and below the reference state, which spikes reflect sheet disturbances to the image-bearing member. Those sheet disturbances were generated by a sheet of paper entering the nip, indicated by a spike up with a smaller spike down, as well as the paper leaving the nip, showing the inverse occurs to a different extent. The jagged, yet generally sinusoidal, reference state reflects roll eccentricities and the drag from stationary rolls. That reference state of motion is associated with the geometry and other properties of the system, such as errors or performance inherent from manufacturing. The jagged spikes are due to external influence on the underlying system, namely the sheet impact and release. An aspect of the disclosed technologies uses ILC to compensate for such external (exogenous) influences.

Figure 7:
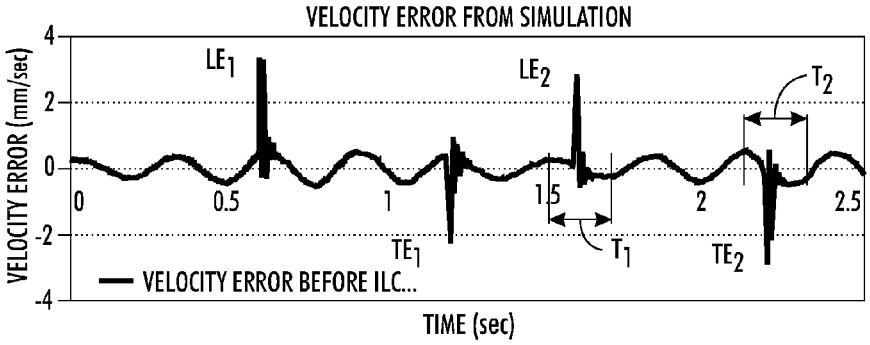
FIG. 7 shows a simulation chart of motion errors on an image-bearing member from the paper entering and exiting a transfer nip, over two iterations without ILC techniques applied.
Figure 8:
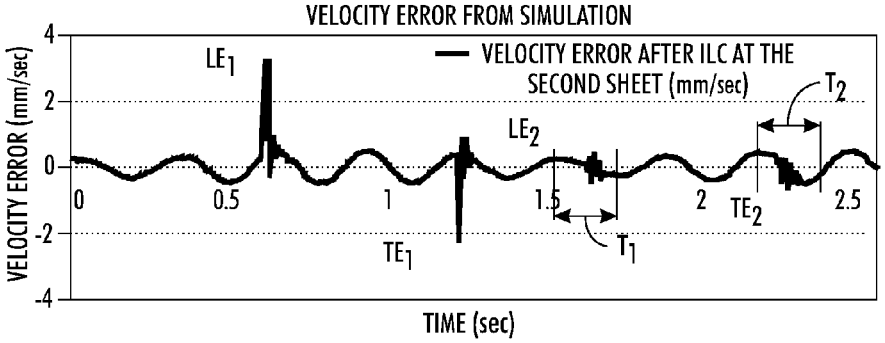
FIG. 8 shows a simulation chart of motion errors on an image-bearing member from the paper entering and exiting a transfer nip, over two iterations with ILC techniques applied to the second iteration using the measurements from the first iteration.

FIGS. 7 and 8 show a simulation with and without ILC from only two iterations of sheet passes through a transfer nip. In both FIGS. 7 and 8 the disturbances are still illustrated by a spiked deviation from an underlying reference state of motion, which is illustrated by a simple sinusoidal curve. In both figures the leading edge impact on the transfer nip is mainly associated with a spiked increase in positive velocity, while the trailing edge release is mainly associated with a somewhat smaller inverted spiked (an increase in negative velocity). The first set of spikes (one primarily up and the other primarily down) is associated with a first iteration that includes a first sheet impact and a first sheet release. As FIG. 7 does not apply ILC, the second set of spikes are almost the same as the first, but represent a second iteration that includes a second sheet impact and a second sheet release. In contrast, FIG. 8 shows how applying ILC can compensate for the second set of disturbances in the second iteration. During the time intervals $T_1$ and $T_2$ a modified velocity profile is applied to image-bearing member. However, the image-bearing member velocity need not be changed for the entire sheet handling period, but rather just during those brief periods encompassing the disturbances. It should be understood that one of ordinary skill could increase or decrease the span of those time intervals in order to improve error reductions, apply a more gentle velocity profile change to the sheet and otherwise achieve an better overall desired system performance.

Figure 9:
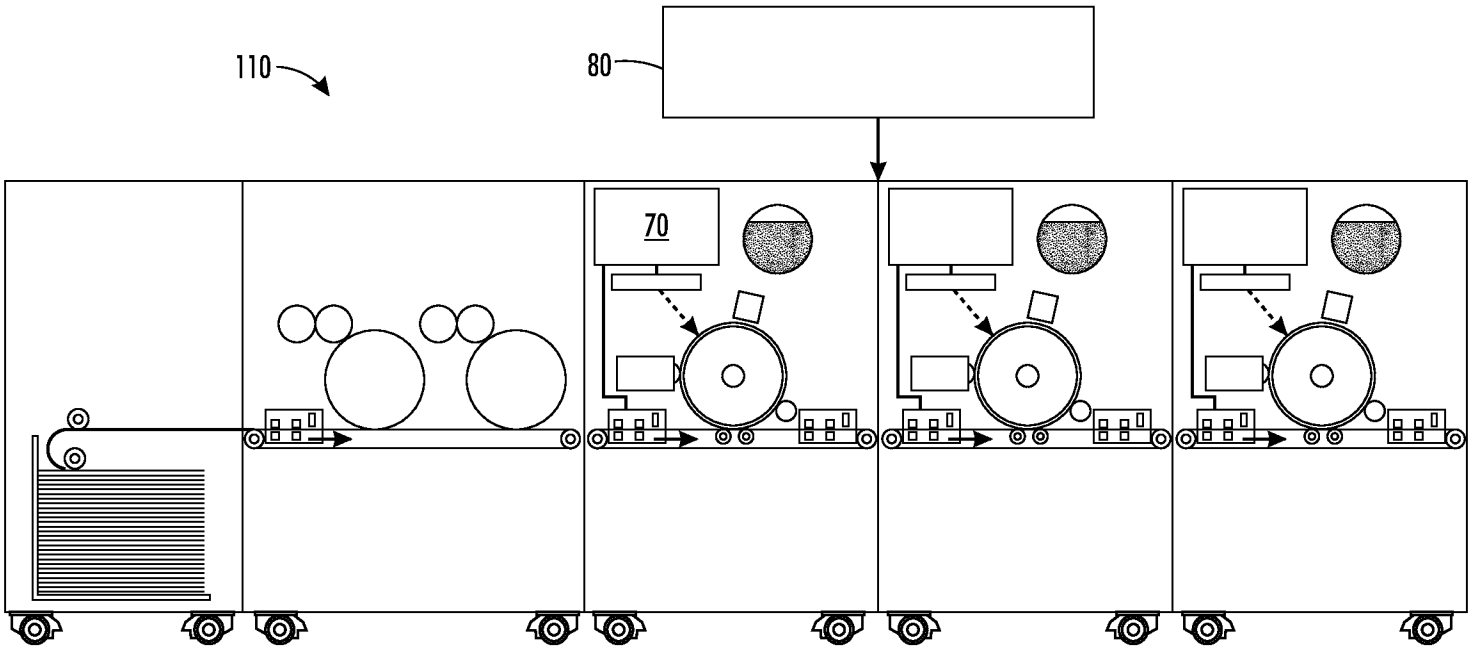
FIG. 9 shows a schematic side elevation view of several modular media handling assemblies working in series with a common controller in accordance with an aspect of the disclosed technologies.

It should be understood that the system and method of reducing registration errors as described herein, can be combined with other forms of registration actuators, sensors and control parameter optimization methods to deliver high performance results. Additionally, in accordance with further aspects of the disclosed technologies herein, the ILC functions can be handled by a common controller 80 that works for more than one media handling assembly, as shown in FIG. 9. Often media handling assemblies, and particularly printing systems, include more than one module or station. Accordingly, more than one registration apparatus as disclosed herein can be included in an overall media handling assembly. Further, it should be understood that in a modular system 110 or a system that includes more than one registration apparatus, the measured disturbance signals can be relayed to a central processor for controlling registration. In this way, particularly in a modular system, one module can learn from the earlier module to further improve the overall media handling. Thus, each sheet passing through a module can be considered a cycle and the number of modules representing that many cycles from which information can be learned regarding the transport handler movements. In this way, the learning system can converge on the ideal signal profile more quickly.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. An apparatus for reducing registration errors in a media handling device, the apparatus comprising:

an image-bearing member for interacting with sheets of substrate media as the sheets individually pass across the image-bearing member, each sheet pass corresponding to one of a series of iterations between the image-bearing member and the sheets, wherein the image-bearing member conveys marking material corresponding to an image;

an actuator communicating motion to the image-bearing member; and a controller operatively coupled to the actuator, wherein the controller receives input signals from one or more sensors arranged to measure at least one disturbance to the image-bearing member at the location where the sheets pass across the image-bearing member with the image-bearing member conveying the marking material thereto, at least a portion of the input signals representing the at least one measured disturbance, each disturbance being defined by a pattern of image-bearing member movement away from and substantially returning to a reference state of motion, a repetition of the pattern being coincident with at least one of the iterations, wherein based on the measured disturbance, the reference state, an indication associated with when the pattern will repeat and one or more measured errors from past iterations, a modified signal is generated for the actuator to adjust the image-bearing member motion in coordination with the indication, wherein the at least one measured disturbance includes image-bearing member movement caused by at least one of sheet impact with and disengagement from the image-bearing member and the one or more measured errors from past iterations are ignored if the measured errors have not repeated multiple times.

2. The apparatus of claim 1, wherein the image-bearing member directly engages one of the sheets during each iteration.

3. The apparatus of claim 1, wherein the reference state is derived from calibration measurements or movement patterns determined from at least one earlier iteration.

4. The apparatus of claim 1, wherein the adjusted image-bearing member motion is effected immediately preceding or immediately after when the pattern is indicated to repeat.

5. The apparatus of claim 1, wherein the image-bearing member is a nip roller or a transfer belt.

6. The apparatus of claim 1, further comprising:

a sheet position sensor for indicating when the pattern will repeat, the sheet position sensor operatively coupled to the controller.

7. The apparatus of claim 1, wherein the at least one measured disturbance measured by the one or more sensors includes two disturbances during the same one of the iterations, and further wherein the two disturbances comprise image-bearing member movement away from and substantially returning to the reference state of motion.

8. The apparatus of claim 7, wherein one of the at least two disturbances corresponds to image-bearing member movement caused by a sheet impact therewith and another of the at least two disturbances corresponds to image-bearing member movement caused by a sheet disengagement from the image-bearing member.

9. The apparatus of claim 1, wherein the reference state of motion comprises a reference velocity of the image-bearing member and the at least one disturbance comprises a measured disturbance from the reference velocity.

10. The apparatus of claim 9, wherein adjusting the image-bearing member motion in coordination with the indication comprises calculating a corrective velocity profile for the image-bearing member.

11. The apparatus of claim 1, wherein after the modified signal is generated for the actuator to adjust the image-bearing member motion, the reference state of motion is modified to generate a new reference state of motion.

12. The apparatus of claim 11, wherein during the iteration j the new reference state of motion $u_{ref\,j+1}$ is generated as equal to the reference state of motion $u_{ref\,j}$ plus a constant K times modified signal $e_j$.

13. The apparatus of claim 12, wherein the new reference state of motion $u_{ref\,j+1}$ is used to calculate a corrective velocity profile for the image-bearing member.

14. The apparatus of claim 12, wherein the modified signal $e_j$ is applied to the reference state of motion $u_{ref\,j}$ before generation of the new reference state of motion.

15. A method of reducing registration errors in a media handling system, the method comprising:

receiving input signals from one or more sensors arranged to measure at least one disturbance to an image-bearing member at the location where the sheets pass across the image-bearing member with the image-bearing member conveying the marking material thereto, wherein the image-bearing member interacts with sheets of substrate media as the sheets individually pass across the image-bearing member, each sheet pass corresponding to one of a series of iterations between the image-bearing member and the sheets, wherein at least a portion of the input signals represent the at least one measured disturbance, each disturbance being defined by a pattern of image-bearing member movement away from and substantially returning to a reference state of motion, a repetition of the pattern corresponding to one of the iterations;

comparing the at least one measured disturbance and the reference state; and generating a modified signal for adjusting the image-bearing member motion in coordination with an indication associated with when the pattern will repeat, the at least one measured disturbance, the reference state and one or more measured errors from past iterations, wherein the at least one measured disturbance includes image-bearing member movement caused by at least one of sheet impact with and disengagement from the image-bearing member and the controller is used as a secondary controller in addition to an existing velocity tracking controller.

16. The method of claim 15, the comparison of the at least one measured disturbance and the reference state repeating over a plurality of consecutive iterations.

17. The method of claim 15, wherein the modified signal at least temporarily changes a velocity profile for an actuator regulating the image-bearing member movement, the velocity profile being changed as a function of a previous velocity profile from a preceding iteration.

18. The method of claim 15, wherein the modified signal adjusts image-bearing member motion to coincide with disengagement between the image-bearing member and one of the sheets.

19. The method of claim 15, wherein the reference state represents movement patterns determined from prior iterations.

20. The method of claim 15, wherein the reference state includes motion characteristics predetermined as a default mode of operation for the image-bearing member.

21. The method of claim 15, further comprising:

receiving the indication of when the pattern will repeat, the indication received from another sensor configured to detect at least one of sheet position and movement characteristics.

* * * * *